United States Patent [19]

Yamamoto et al.

[11] Patent Number: 4,492,197

[45] Date of Patent: Jan. 8, 1985

[54] OVER-REVOLUTION PREVENTING APPARATUS FOR INTERNAL COMBUSTION ENGINES

[75] Inventors: Yasuo Yamamoto, Hamamatsu; Isao Kanno, Shizuoka, both of Japan

[73] Assignee: Sanshin Kogyo Kabushiki Kaisha, Japan

[21] Appl. No.: 538,097

[22] Filed: Oct. 3, 1983

[30] Foreign Application Priority Data

Oct. 4, 1982 [JP] Japan ..... 57-172153

[51] Int. Cl.[3] ..... F02N 15/10; F02P 1/00; F02D 33/00

[52] U.S. Cl. ..... 123/630; 123/198 DC; 123/48 D; 123/334

[58] Field of Search ..... 123/630, 198 D, 198 DC, 123/334, 335, 618, 332, 333

[56] References Cited

U.S. PATENT DOCUMENTS

| | | | |
|---|---|---|---|
| 3,563,219 | 2/1971 | Miearas | 123/335 |
| 3,703,889 | 11/1972 | Bodig et al. | 123/198 DC |
| 3,863,616 | 2/1975 | Wood | 123/198 DC |
| 4,144,859 | 3/1979 | Ohki et al. | 123/335 |
| 4,171,687 | 10/1979 | Coventry | 123/335 |
| 4,204,490 | 5/1980 | Ohki et al. | 123/335 |
| 4,223,657 | 9/1980 | Sato et al. | 123/198 D |
| 4,366,778 | 6/1982 | Howard | 123/334 |
| 4,403,970 | 9/1983 | Dretzka et al. | 440/75 |
| 4,421,082 | 12/1983 | Katayose et al. | 123/333 |

*Primary Examiner*—Raymond A. Nelli

*Attorney, Agent, or Firm*—Ernest A. Beutler

[57] ABSTRACT

An electronic revolution rate limiting apparatus is described which generally comprises a transducer for generating a tachometer signal which is indicative of the revolution rate of the internal combustion engine, a circuit for producing a control signal which is responsive to the tachometer signal and the operation state of the engine and which determines the maximum revolution rate for each of a plurality of operation states, and a switch for interacting with the ignition system of the engine to prevent a sparking voltage from being induced in the ignition system in response to the value of the control signal. When the revolution rate limiting apparatus is employed in a power plant in which the operation states comprise a plurality of drive states (e.g., forward, neutral, reverse), the circuit for producing the control signal is also responsive to which drive state the power plant is in, such that the maximum revolution rate may be individually controlled for each drive state.

19 Claims, 10 Drawing Figures

OVER-REVOLUTION PREVENTING APPARATUS FOR INTERNAL COMBUSTION ENGINES

BACKGROUND OF THE INVENTION

The present invention relates generally to internal combustion engines, and particularly to an apparatus for electronically limiting the revolution rate of internal combustion engines.

Internal combustion engines are designed to operate over certain speed ranges, which are generally expressed in revolutions per minute (RPM). To insure that these engines are not operated above the maximum rated speed, various techniques have been employed for mechanically limiting the speed of the engine. In one such technique, a mechanical linkage is employed to limit or block the travel of the throttle linkage beyond a certain point. Although mechanical linkages are effective for this purpose, it will be appreciated that these mechanical linkages can become relatively complex when more than one maximum speed is desirable. For example, in a motor or power plant which is designed to operate in different operation states, such as drive states (e.g., forward, neutral or reverse), it is generally advantageous to permit a different maximum speed for each drive speed. Thus, it will be appreciated that it is typically desirable to have a lower maximum speed for the engine when the power plant is in neutral (or other no load condition) than when the power plant is in forward, and so forth.

It is, therefore, a principal object of this invention to provide an improved apparatus and method for limiting the speed of an internal combustion engine which does not depend upon mechanical linkages and is also capable of permitting a plurality of maximum speeds for the engine.

It is another object of the present invention to provide an apparatus and method for electronically limiting the revolution rate of an internal combustion engine through an interaction with the ignition system for the engine.

It is a further object of the present invention to provide an electronic revolution rate limiting apparatus and method for limiting the engine speed when the power plant is shifted from one drive state to another.

SUMMARY OF THE INVENTION

To achieve the foregoing objects, the present invention provides an electronic revolution rate limiting apparatus which generally comprises means for generating a tachometer signal which is indicative of the revolution rate of the internal combustion engine, means for producing a control signal which is responsive to the tachometer signal and the operation state of the engine and which determines the maximum revolution rate for each of a plurality of operation states, and means for interacting with the ignition system of the engine to prevent a sparking voltage from being induced in the ignition system in response to the value of the control signal. When the revolution rate limiting apparatus is employed in a power plant in which the operation states comprise a plurality of drive states (e.g., forward, neutral, reverse), the means for producing the control signal is also responsive to which drive state the power plant is in, such that the maximum revolution rate may be individually controlled for each drive state.

In accordance with one feature of the present invention, the revolution rate limiting apparatus interacts with a capacitive discharge ignition system. In this embodiment, the interacting means generally comprises a switch which is connected to the trigger circuit of the ignition system such that the discharging of a capacitor is prevented by the switch in response to the value of the control signal.

In accordance with another feature of the present invention, the interacting means comprises a switch which is connected across the primary winding of the ignition coil of the ignition system to selectively provide a short circuit across the primary winding in response to the value of the control signal.

Additional advantages and features of the present invention will become apparent from a reading of the detailed description of the preferred embodiments which makes reference to the following set of drawings, in which:

DETAILED DESCRIPTION OF THE PREFERRED EMBODIMENT

Figure 1:
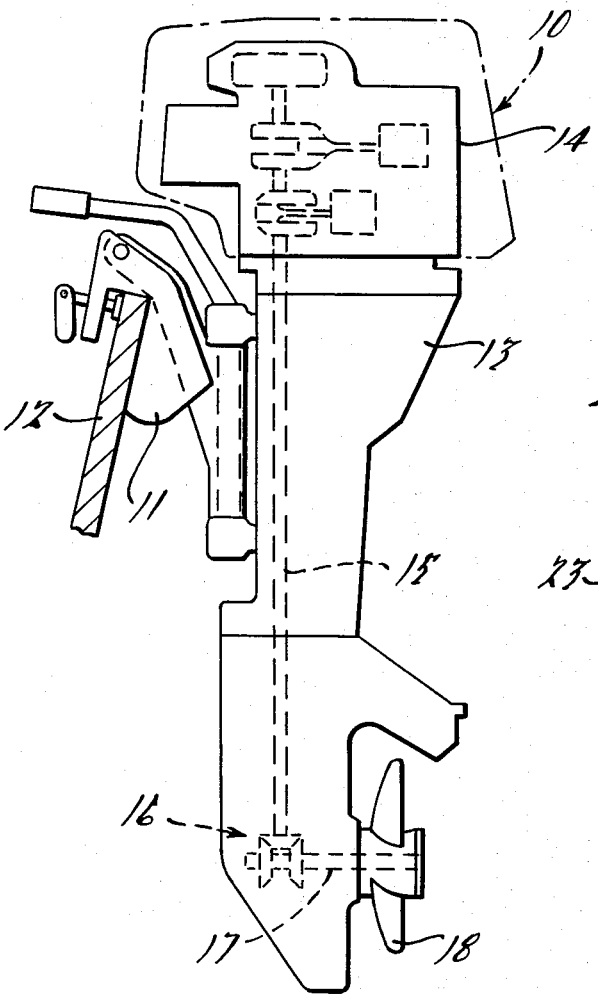
FIG. 1 is a diagrammatic view of an outboard motor having a revolution rate limiting apparatus constructed in accordance with an embodiment of the present invention and operating in accordance with a method of the present invention.

Referring to FIG. 1, an outboard motor having a revolution rate limiting circuit in accordance with an embodiment of this invention is identified generally by the reference numeral 10. The outboard motor 10 includes a swivel bracket 11 for mounting the motor to the stern or transom 12 of a boat. The heart of the outboard motor 10 is an internal combustion engine 14, which is depicted as having two cylinders and an output shaft 15. The output shaft 15 extends through a drive shaft housing 13, and is coupled to a propeller shaft 17 through transmission gears 16. A propeller 18 is fixedly secured to the propeller shaft 17 such that the propeller will rotate with the propeller shaft.

The transmission gears 16 operate with a manually actuated shifting linkage (not shown) to change the drive state of the outboard motor 10. Thus, the transmission gears 16 are operable to convert the rotation of the engine output shaft 15 into a "forward" or "reverse" rotation of the propeller shaft 17. Additionally, the transmission gears 16 are operable to decouple the propeller shaft 17 from the output shaft 15 to provide a "neutral" drive state in which no load is placed upon the engine 14.

While the present invention is described in connection with the outboard motor 10, it will become readily apparent to those skilled in the art that the invention may be susceptible for use with other types of engines and power plants. It should also be understood that the present invention may also be susceptible with additional or different operation or drive states than those provided by the outboard motor 10.

Figure 2:
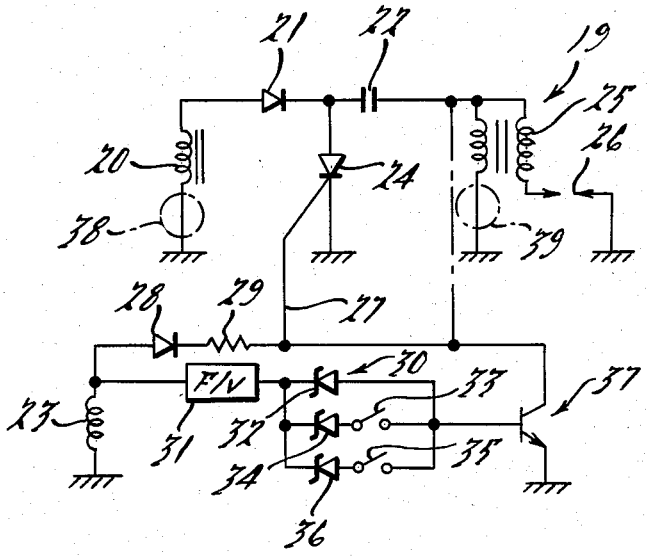
FIG. 2 is a schematic diagram showing one embodiment of an ignition system and revolution rate limiting apparatus employable in the outboard motor illustrated in FIG. 1.

Referring to FIG. 2, a schematic diagram of an ignition system circuit and a revolution rate limiting circuit is shown which is employable in the outboard motor 10 of FIG. 1. The ignition system includes an ignition coil 19 and a trigger circuit which comprises a generating coil 20, a diode 21, a capacitor 22 and a silicon controlled rectifier (SCR) 24. As will be appreciated by those skilled in the art, the ignition system is a magneto-type capacitive discharge ignition system, which uses the rotation of permanent magnets on the flywheel of the engine 14 to induce a voltage in the generating coil 20. During positive excursions of the alternating voltage induced in the generating coil 20, the capacitor 22 is charged. The diode 21 is connected between the generating coil 20 and the capacitor 22 to prevent the capacitor from discharging during negative excursions of the voltage induced in the generating coil.

In order to generate a voltage in the secondary winding 25 of the ignition coil 19 which will cause the spark plug 26 to produce a spark across its electrodes, the SCR 24 must be gated on at the appropriate time. This will permit the capacitor 22 to discharge through the loop which includes the primary winding of the ignition coil 19, and cause the firing of the spark plug 26 in a known manner.

The gating of the SCR 24 is controlled in part by a pulser coil 23. The pulser coil 23 is designed to generate a pulse with each revolution of the flywheel of the engine by virtue of an additional permanent magnet located on the engine flywheel. These pulses are transmitted to the gate of the SCR 24 via diode 28 and resistor 29.

Since the frequency at which the pulses are generated by the pulser coil 23 is directly related to the rate at which the output shaft 15 of the engine rotates, the pulses generated by the pulser coil also provides a tachometer signal which is indicative of the revolution rate or speed of the engine 14. Thus, the pulser coil not only provides a trigger signal for the ignition system, but also provides a speed transducer for the revolution rate limiting apparatus in accordance with the present invention.

The revolution rate limiting apparatus of FIG. 2 features a switching circuit 30 and a frequency to voltage converter 31. The converter 31 is used to convert the tachometer signal pulses generated by the pulser coil 23 into a voltage signal whose magnitude is dependent upon the frequency of the pulses. The switching circuit 30 comprises zener diodes 32, 34 and 36 and switch contacts 33 and 35. Each of the zener diodes 32, 34 and 36 are used to determine an individually selected, maximum revolution rate for a predetermined drive state of the outboard motor 10. In this embodiment, the zener diode 32 is used for the forward drive state by providing a breakdown voltage corresponding to a revolution rate of 6000 RPMs. Similarly, the zener diode 34 provides a maximum revolution rate of 3500 RPMs for the neutral drive state, and the zener diode 36 provides a maximum revolution rate of 4000 RPMs for the reverse drive state. Of course, it should be understood that these maximum revolution rates are intended to be exemplary only, and that other suitable maximum revolution rates may also be provided in the appropriate application.

The switch contacts 33 and 35 are responsive to the particular drive state of the outboard motor 10, and may be formed as part of a switching mechanism which is controlled by the transmission shifting linkage. Thus, in the forward drive state, both of the switch contacts 33 and 35 will be opened, as shown in FIG. 2. Similarly, in the neutral drive state, the switch contact 33 will be closed, and in the reverse drive state, the switch contact 35 will be closed.

The output of the switching circuit 30 is a control signal which is used to turn on and off a controlled conduction device, such as transistor 37. The transistor 37 is connected to the ignition system in a switch configuration, with its collector connected to the gate of the SCR 24. As long as the revolution rate of the engine 14 does not exceed the maximum revolution rate for the particular drive state which the outboard motor 10 is in, then the control signal will have a digitally LO value which will maintain the transistor in an off condition. In this condition, the ignition system will function in a normal manner to fire the spark plug at the appropriate time intervals.

However, when the revolution rate exceeds the maximum revolution rate for the particular drive state of the outboard motor 10, the transistor 37 will interact with the ignition system to prevent a sparking voltage from being induced in the secondary winding 25 of the ignition coil 19. Specifically, the frequency to voltage converter 31 will produce a voltage signal level which will exceed the breakdown voltage of the appropriate zener diode, such as zener diode 32, when the outboard motor 10 is in the forward drive state. This will cause the switching circuit 30 to produce a control signal which will have a digitally HI value, or a value which is otherwise sufficient to cause the transistor 37 to conduct or turn on. When the transistor 37 is in an on condition, the pulses generated by the pulser coil 23 will be transmitted through the transistor, thereby preventing or interrupting the gating signal to the SCR 24 which is necessary in order to permit the capacitor 22 to discharge and fire the spark plug 26. This interruption will continue until the revolution rate has decreased below the appropriate maximum revolution rate. It should also be noted at this point that if the outboard motor 10 is shifted from the forward drive state to the neutral drive state at a revolution rate which exceeds 3500 RPMs, then the revolution rate limiting apparatus will respond by interrupting the firing of the spark plug 26 until the revolution rate drops below the 3500 RPM maximum revolution rate for the neutral drive state.

In one variation of the revolution rate limiting apparatus according to the present invention, the transistor 37 is connected across the primary winding of the ignition coil 19 (as shown by the phantom line in FIG. 2). In this configuration, the capacitor 22 is permitted to discharge during an over-revolution condition, however, the transistor 37 will create a short circuit across the primary winding which will prevent a sparking voltage from being induced in the secondary winding 25 of the ignition coil 19. In accordance with additional variations of the revolution rate limiting apparatus, a controlled conduction device or other electronic switch could be connected in the ignition system at either of the phantom circles 38 and 39. In this configuration, the switch 38 or the switch 39 will shut off the flow of electrical current in the appropriate branches of the ignition system circuit when the engine 14 operates over its predetermined maximum revolution rate.

Figure 3:
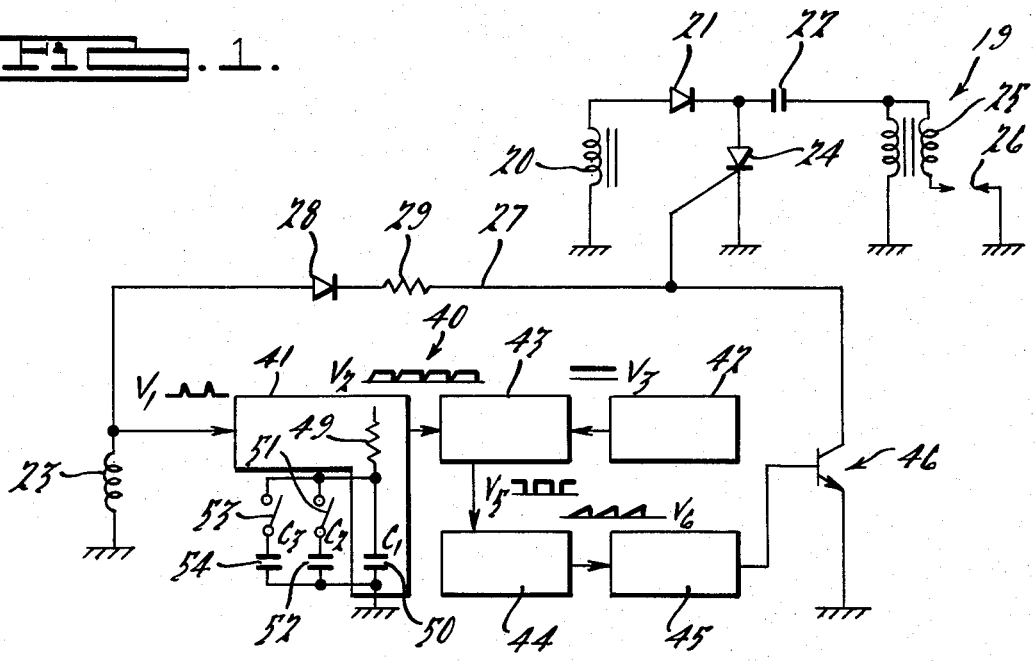
FIG. 3 is a schematic diagram showing another embodiment of an ignition system and revolution rate limiting apparatus employable in the outboard motor illustrated in FIG. 1.

Referring now to FIG. 3, a schematic diagram of another embodiment of a revolution rate limiting apparatus 40 in accordance with the present invention is shown. While the revolution rate limiting apparatus 40 of FIG. 3 is employed in conjunction with the same magneto-type capacitive discharge ignition system shown in FIG. 2, it should be understood that the present invention may be susceptible for use with other types of ignition system as well. In the revolution rate limiting apparatus 40, the pulses of the tachometer signal "$V_1$" from the pulser coil 23 are transmitted to a ramp generator 41 which in turn produces a voltage signal "$V_2$". The rate at which the voltage signal $V_2$ rises is dependent upon the timing controlled by the resistor 49 and predetermined combinations of the capacitors 50, 52 and 54.

Figure 4:
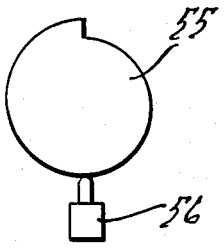
FIG. 4 is a diagrammatic view of a switching mechanism which forms part of the revolution rate limiting apparatus of FIG. 3.

The switch contacts 51 and 52 are used to control whether or not the capacitors 52 and 54 are employed by the ramp generator 41. These switch contacts form part of the switch mechanism 56, which is shown in FIG. 4. The switch mechanism 56 is coupled to a rotatable shaft 55 of the transmission shifting linkage such that the rotation of the shaft 55 which occurs when the drive state of the outboard motor 10 is changed, will appropriately open or close the contacts 51 and 53.

Figure 5A:
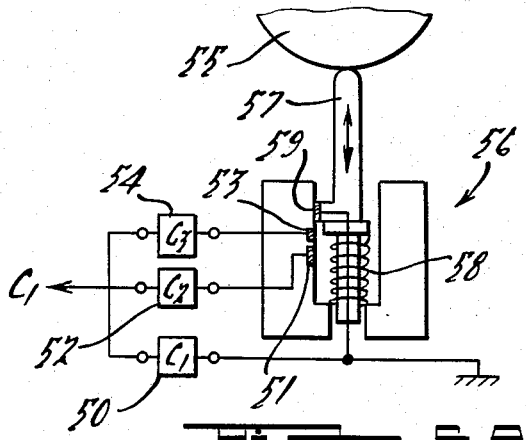
FIG. 5A is an enlarged diagrammatic view of the switching mechanism of FIG. 4, which particularly illustrates the switching mechanism in a forward drive state.

Referring to FIG. 5A, an enlarged diagrammatic view of the switch mechanism 56 is shown to include an actuator rod 57 which is reciprocally mounted in a bore of the switch mechanism housing. A spring 58 is used to bias the actuator rod 57 into engagement with the rotatable shaft 55. The shaft 55 or a cam thereof is formed such that its rotation will cause an axial displacement of the actuator rod 57. This axial displacement will cause a sliding contact 59 disposed on the actuator rod 57 to come into or out of electrical contact or engagement with predetermined combinations of the contacts 51 and 53.

Specifically, FIG. 5A illustrates the position of the switching mechanism actuator rod 57 when the outboard motor is in the forward drive state. In this drive state, both of the contacts 51 and 53 are open or disengaged from the sliding contact 59. Accordingly, only the capacitor 50 is used to determine the shape of the voltage signal $V_2$.

Figure 5B:
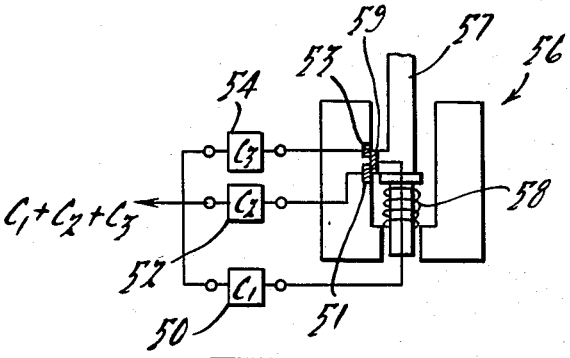
FIG. 5B is another diagrammatic view of the switching mechanism of FIG. 4, which particularly illustrates the switching mechanism in a neutral drive state.

FIG. 5B illustrates the switching mechanism 56 in the neutral drive state, where both of the contacts 51 and 53 are closed, and all three capacitors are operable.

Figure 5C:
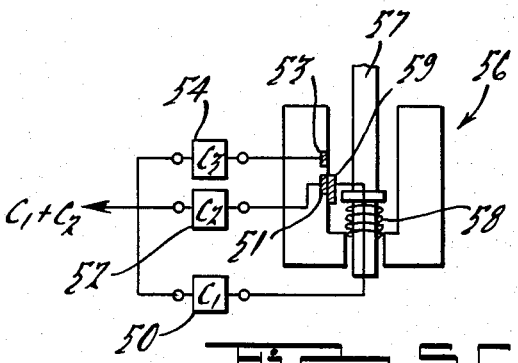
FIG. 5C is another diagrammatic view of the switching mechanism of FIG. 4, which particularly illustrates the switching mechanism in a reverse drive state.

Similarly, FIG. 5C illustrates the switching mechanism 56 in the reverse drive state, where only the contact 51 is closed. It should be appreciated that the switching mechanism 56 is intended to be exemplary only and that other suitable switching mechanisms may be employed in the appropriate applications.

Referring again to FIG. 3, the revolution rate limiting apparatus 40 is shown to further include a constant voltage source 42, a comparator 43, a second ramp generator 44, a switch 45 and a transistor 46. The comparator 43 receives the constant voltage signal $V_3$ from the source 42 and the voltage signal $V_2$ from the ramp generator 41, and produces a digital voltage signal $V_5$ therefrom. Specifically, the comparator 43 will produce a HI logic state for the voltage signal $V_3$ when the voltage signal $V_2$ exceeds the magnitude of the constant voltage signal $V_3$. When the magnitude of the voltage signal $V_2$ is below that of the constant voltage signal $V_3$, the comparator will produce a LO logic state output for the voltage signal $V_5$.

The voltage signal $V_5$ is used to trigger the ramp generator 44 such that the voltage signal $V_6$ will be permitted to rise at a constant rate when the voltage signal $V_5$ is in a LO logic state. When the voltage signal $V_6$ reaches a predetermined magnitude, the switch 45, which may be, for example, a zener diode, will cause a control signal to be transmitted to the transistor 46 like that described with reference to FIG. 2.

Figure 8:
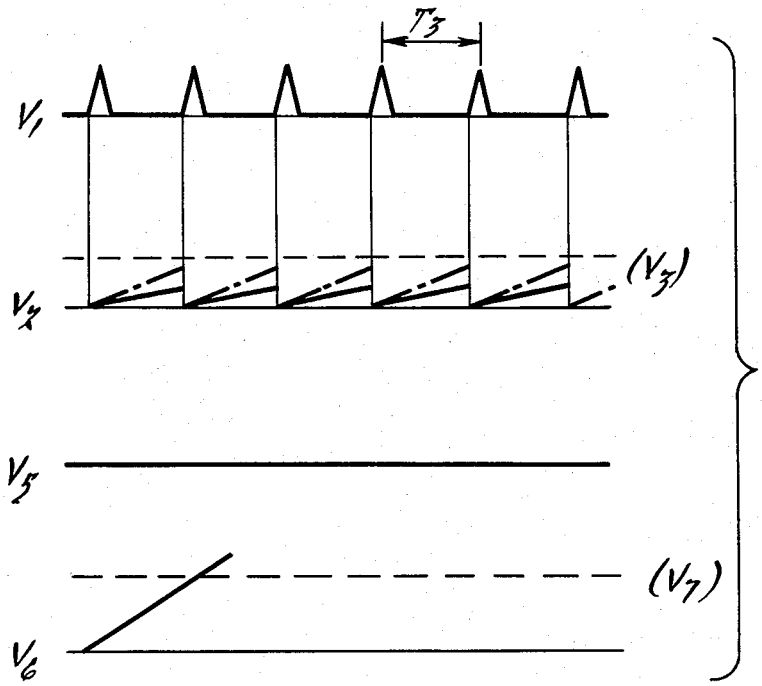
FIG. 8 is another graph showing the operation of the revolution rate limiting apparatus of FIG. 3, which particularly illustrates an over revolution condition for both the forward and neutral drive states.
Figure 6:
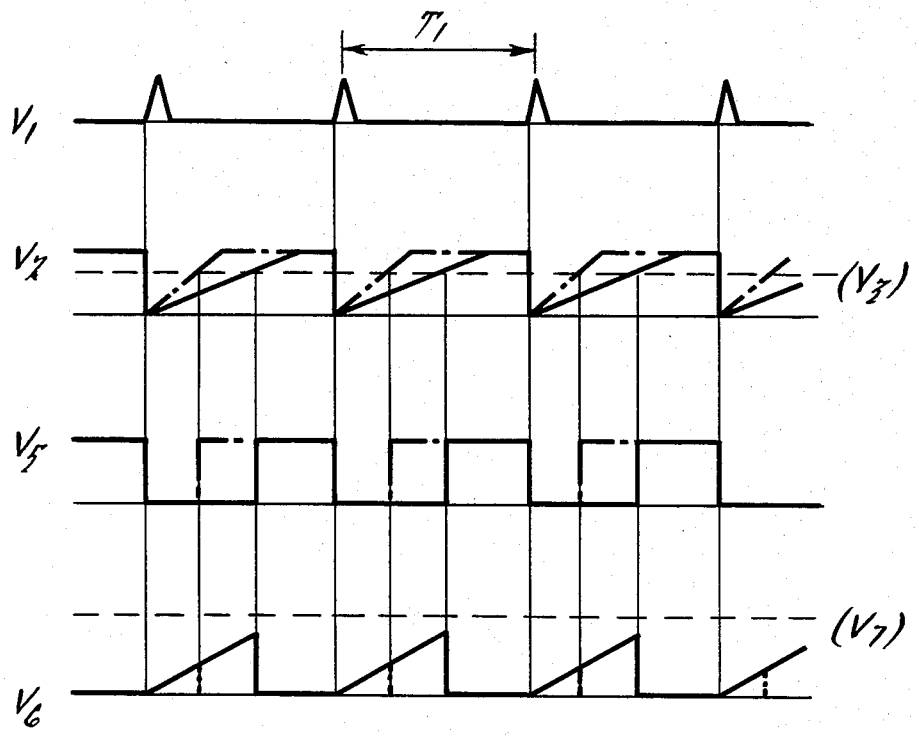
FIG. 6 is a graph showing the operation of the revolution rate limiting apparatus of FIG. 3, which illustrates an under revolution condition for both the forward and neutral drive states.
Figure 7:
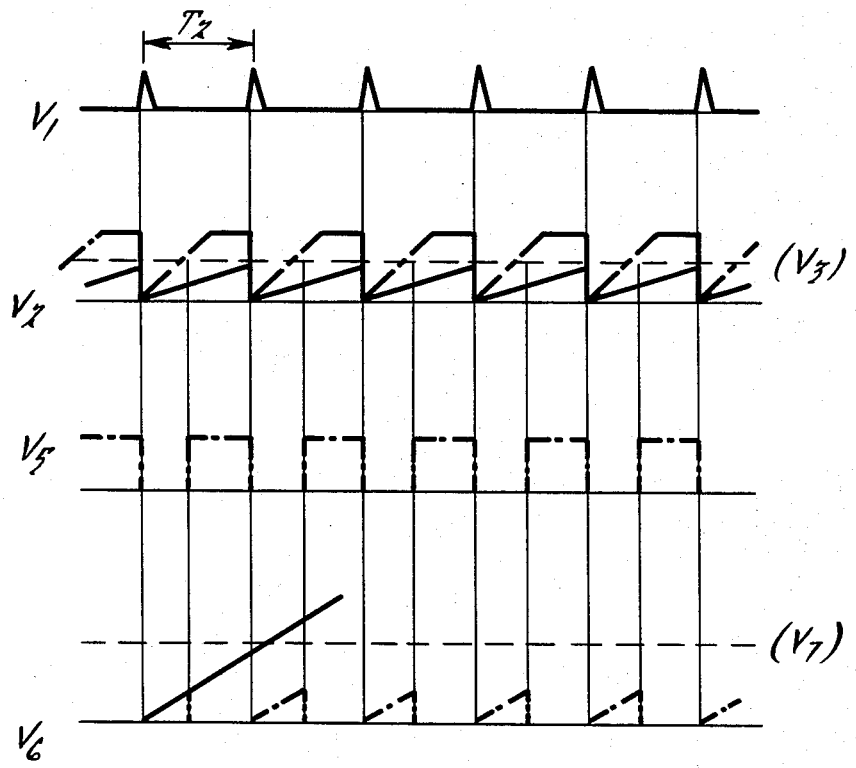
FIG. 7 is another graph showing the operation of the revolution rate limiting apparatus of FIG. 3, which particularly illustrates an under revolution condition for the forward drive state and an over revolution condition for the neutral drive state.

Referring now to FIGS. 6–8, three graphs are shown which illustrate the method of operation for the revolution rate limiting apparatus 40 of FIG. 3. Specifically, these graphs illustrate the voltage signals $V_1$–$V_7$ with respect to time for both the forward and neutral drive states. The signals for the forward drive states are indicated by the broken lines, while the signals for the neutral drive state are indicated by the solid lines.

FIG. 6 illustrates a revolution rate which represents an under revolution condition for both the forward and neutral drive states. That is, the time "$T_1$" between the pulses of the tachometer signal $V_1$ is such that the revolution rate will be below the maximum revolution rates for both the forward and neutral drive states. Thus, at the occurrence of each tachometer signal pulse, the voltage signal $V_2$ begins to rise at a rate which is dependent upon which drive state the outboard motor is in. Since the revolution rate is relatively low, the magnitude of the voltage signal $V_2$ will exceed that of the constant voltage signal $V_3$ before the occurrence of the next tachometer signal pulse. When this magnitude is exceeded, the comparator 43 will switch from a LO to a HI logic state. This switching will interrupt the rising magnitude of the voltage signal $V_6$, which also began rising at the same time as the voltage signal $V_2$. Accordingly, the magnitude of the voltage signal $V_6$ is not permitted to rise to the threshold voltage level $V_7$ of the switch 45, and therefore, the transistor will remain in an off condition.

FIG. 7 illustrates a higher revolution rate than that shown in FIG. 6, and one in which the maximum revolution rate for the neutral drive state has been exceeded. Accordingly, in the neutral drive state, the earlier occurrence of the next tachometer signal pulse will permit the magnitude of the voltage signal $V_6$ to increase beyond the threshold voltage level $V_7$ of the switch 45. Thus, in the neutral drive state, the switch 45 will produce a control signal which will cause the transistor 46 to turn on and prevent a sparking voltage from being induced in the secondary winding 25 of the ignition coil 19.

Finally, FIG. 8 illustrates a revolution rate which will result in an over-revolution condition for both the neutral and forward drive states. That is, the time "$T_3$" between the tachometer signal pulses is such that the revolution rate will exceed the maximum revolution rates for both the neutral and the forward drive states.

Although only a limited number of embodiments of the invention have been illustrated and described, it is to be understood that various changes and modifications may be made without departing from the spirit and scope of the invention as defined by the appended claims.

We claim:

1. In an internal combustion engine which is capable of operating in a plurality of selectable operation states and has an ignition system, a revolution rate limiting apparatus, comprising:

means for generating a tachometer signal indicative of the revolution rate of said internal combustion engine;

means for producing a control signal which is responsive to said tachometer signal and the operation state of said internal combustion engine, and which determines a maximum revolution rate for each of said plurality of operation states, said means for producing said control signal including a frequency to voltage converter which receives said tachometer signal; and means for interacting with said ignition system to prevent a sparking voltage from being induced in said ignition system in response to the value of said control signal.

2. The invention according to claim 1, wherein said ignition system is a capacitive discharge ignition system, and said interacting means prevents a capacitor in said ignition system from being discharged through the primary winding of an ignition coil in said ignition system.

3. The invention according to claim 1, wherein said means for generating said tachometer signal includes a pulse generating coil.

4. The invention according to claim 1, wherein said interacting means includes a controlled conduction device connected electrically in parallel with the primary winding of said ignition coil, which is gated on by said control signal to provide an electrical current path of low resistance across the primary winding of said ignition coil when the maximum revolution rate is attained.

5. In a power plant having an internal combustion engine, a shaft for transmitting the mechanical power produced by said internal combustion engine, and a transmission for selectively shifting said shaft into one of a plurality of drive states, a revolution rate limiting apparatus, comprising:

means for generating a tachometer signal indicative of the revolution rate of said internal combustion engine;

means for producing a control signal which is responsive to said tachometer signal and the drive state of said shaft and which determines a maximum revolution rate for each of said plurality of drive states;

switching means, associated with an ignition system of said internal combustion engine, for preventing a sparking voltage from being induced in the secondary winding of an ignition coil in said ignition system, in response to said control signal.

6. The invention according to claim 5, wherein said means for generating said tachometer signal includes a pulse generating coil.

7. The invention according to claim 5, wherein said ignition system is a capacitive discharge ignition system.

8. The invention according to claim 7, wherein said capacitive discharge ignition system includes a controlled conduction device for selectively permitting the discharging of a capacitor through the primary winding of said ignition coil, and said switching means is connected to said controlled conduction device such that said switching means controls the gating of said controlled conduction device.

9. The invention according to claim 7 wherein said switching means includes a controlled conduction device connected electrically in parallel with the primary winding of said ignition coil, which is gated on by said control signal to provide an electrical current path of low resistance across the primary winding of said ignition coil when the maximum revolution rate for the drive state of said shaft is attained.

10. The invention according to claim 5, wherein said means for producing said control signal includes means fo converting the frequency of said tachometer signal into an analog voltage signal, and switching circuit means which is responsive to the drive state of said shaft and said analog signal for producing a first value for said control signal when the revolution rate is less than the maximum revolution rate for the drive state of said shaft and for producing a second value for said control signal when the revolution rate has attained the maximum revolution rate for the drive state of said shaft.

11. The invention according to claim 5, said plurality of drive states include forward, neutral and reverse.

12. The invention according to claim 11, wherein said power plant is a marine outboard motor.

13. A method for electronically limiting the revolution rate of an internal combustion engine in a power plant having a shaft for transmitting the mechanical power produced by said internal combustion engine and a transmission for selectively shifting said shaft into one of a plurality of drive states, comprising the steps of:

measuring the revolution rate of said internal combustion engine;

determining if the revolution rate measured exceeds a predetermined maximum revolution rate for the particular drive state of said internal combustion engine; and generating a signal in response thereto which will interact with an ignition system of said internal combustion engine to prevent the firing of a spark plug in said internal combustion engine.

14. The invention according to claim 1, wherein said means for producing said control signal includes a zener diode for each of said plurality of operation states, said zener diodes being operatively connected to the output of said frequency to voltage converter and said zener diodes defining the maximum revolution rate of each of said plurality of operation states.

15. The invention according to claim 14, wherein said means for producing said control signal includes at least one switch which is operatively connected to one of said zener diodes and is responsive to the operation state of said internal combustion engine.

16. The invention according to claim 2, wherein said interacting means includes a controlled conduction device which is operatively connected to the gate of an SCR which controls the discharging of said capacitor, such that when said controlled conduction device conducts in response to said control signal, said SCR is prevented from conducting.

17. The invention according to claim 1, wherein said frequency to voltage converter generates an analog voltage ramp signal, and said means for producing said control signal includes capacitor means operatively connected to said frequency to voltage converter for controlling the rate at which said ramp signal rises in response to the operating state of said internal combustion engine.

18. The invention according to claim 17, wherein said means for producing said control signal further includes a comparator which is responsive to said ramp signal and a predetermined voltage level signal, a ramp generator which is responsive to the voltage level output of said comparator, and a switch produces said control signal in response to the voltage level output of said ramp generator.

19. The invention according to claim 18, wherein said switch is a zener diode, and said interacting means is a transistor whose conduction is responsive to said control signal.

* * * * *